US010300699B2

(12) United States Patent
Seki et al.

(10) Patent No.: US 10,300,699 B2
(45) Date of Patent: May 28, 2019

(54) LIQUID DISCHARGE HEAD, LIQUID DISCHARGE APPARATUS, AND MANUFACTURING METHOD

(71) Applicant: CANON KABUSHIKI KAISHA, Tokyo (JP)

(72) Inventors: Sayaka Seki, Kawasaki (JP); Yuichiro Akama, Tokyo (JP); Yuji Tamaru, Yokohama (JP); Naoko Tsujiuchi, Kawasaki (JP); Yasuaki Kitayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/661,870

(22) Filed: Jul. 27, 2017

(65) Prior Publication Data

US 2018/0029364 A1 Feb. 1, 2018

(30) Foreign Application Priority Data

Jul. 29, 2016 (JP) ..... 2016-149980

(51) Int. Cl.
*B41J 2/175* (2006.01)
*B41J 2/14* (2006.01)
*B41J 2/15* (2006.01)

(52) U.S. Cl.
CPC ..... *B41J 2/1433* (2013.01); *B41J 2/15* (2013.01); *B41J 2/1752* (2013.01); *B41J 2/17523* (2013.01); *B41J 2/17559* (2013.01)

(58) Field of Classification Search
CPC ..... B41J 2002/14475
See application file for complete search history.

(56) References Cited

U.S. PATENT DOCUMENTS

2002/0063756 A1* 5/2002 Tsuchii ..... B41J 2/1404 347/65
2005/0117000 A1* 6/2005 Shimizu ..... B41J 2/17509 347/85

FOREIGN PATENT DOCUMENTS

JP 2010-76394 A 4/2010
JP 5153427 B2 2/2013

* cited by examiner

*Primary Examiner* — Geoffrey S Mruk
*Assistant Examiner* — Scott A Richmond
(74) *Attorney, Agent, or Firm* — Canon U.S.A., Inc. IP Division

(57) ABSTRACT

A liquid discharge head includes a recording element substrate having first to fourth discharge port groups, each of which includes a plurality of discharge ports for discharging liquid, first flow path connecting a first liquid tank to the first discharge port group, a second flow path connecting a second liquid tank to the second discharge port group, and a third flow path connecting a third liquid tank to the third discharge port group and the fourth discharge port group, wherein a flow resistance in the first flow path is smaller than a flow resistance in the second flow path and larger than a flow resistance in the third flow path, and wherein a ratio of the flow resistance in the second flow path to the flow resistance in the third flow path is 4 or less.

6 Claims, 14 Drawing Sheets

LIQUID DISCHARGE HEAD, LIQUID DISCHARGE APPARATUS, AND MANUFACTURING METHOD

BACKGROUND OF THE INVENTION

Field of the Invention

The disclosure relates to a liquid discharge head, a liquid discharge apparatus, and a manufacturing method.

Description of the Related Art

A liquid discharge apparatus for, for example, performing recording processing by discharging a liquid from a discharge port has been widely used. This type of liquid discharge apparatus includes a liquid discharge head. The liquid discharge head includes a plurality of discharge ports formed in a recording element substrate, a pressure chamber communicating with each of the discharge ports, and a flow path for supplying the liquid to the pressure chamber. The liquid is supplied from a liquid tank to the liquid discharge head. In such a liquid discharge head, an air bubble is sometimes formed in the liquid in the flow path and the pressure chamber. An air bubble left as it is may disturb the supply the liquid and cause a discharging failure. For this reason, the main body of the liquid discharge apparatus includes suction recovery means that performs a suction recovery process for removing a formed air bubble by suction.

Some liquid discharge heads have a plurality of discharge port arrays, which is provided on a recording element substrate, for discharging different types of liquid. In general, this type of liquid discharge head performs the suction recovery process by simultaneously covering the discharge port arrays formed on a single member using a cap and depressurizing the inside of the cap by a suction pump.

A desirable negative pressure in suction for depressurization using the suction pump is a degree sufficient for removing the air bubble by suction and not drawing a bubble from the liquid tank. Such a degree of negative pressure of suction varies depending on flow resistance in a path from the liquid tank to the discharge port. Flow resistance in a path from the liquid tank to the discharge port may greatly vary among different types of liquid, depending on a structure of the liquid discharge apparatus. For example, Japanese Patent Application Laid-Open No. 2010-76394 discusses a liquid discharge apparatus having differences in sizes of discharge ports for discharging a liquid and differences in the number of arrays of discharge ports connected to one liquid tank, depending on types of liquid. When there are variations in the number of discharge port arrays connected to one liquid tank, the number of discharge ports connected to one liquid tank varies. Consequently, the sum of the opening areas of the discharge ports greatly varies among liquid tanks. The flow resistance therefore greatly varies among flow paths from the liquid tank to discharge ports.

In a case where the flow resistance greatly varies among flow paths from the liquid tank to the discharge ports, it is difficult to set a suction amount well-balanced among the flow paths using such a method that a suction is simultaneously performed for a plurality of flow paths as described above. It is therefore difficult for the above-described liquid discharge apparatus to adopt a recovery method using simultaneous suction.

To address such an issue, Japanese Patent No. 5153427 discusses a liquid discharge head that adjusts a difference between flow resistances occurring in flow paths from liquid tanks to discharge ports using filter provided at an opening portion of each liquid inlet.

However, in the liquid discharge head discussed in Japanese Patent No. 5153427, the resistance occurring in the filter is small relative to the flow resistance occurring in the flow path. The liquid discharge head therefore has limitation in an adjustable flow resistance range in reality. Moreover, no consideration is given to the degree of flow-resistance difference that allows adoption of the recovery method using simultaneous suction. Accordingly, the liquid discharge head often still has difficulty in adopting the method of simultaneous suction recovery.

SUMMARY OF THE INVENTION

The disclosure is directed to a liquid discharge head capable of subjecting a plurality of liquids to a simultaneous suction for recovery, by reducing a flow-resistance difference between flow paths.

According to an aspect of the present disclosure, a liquid discharge head includes recording element substrate having a first discharge port group, a second discharge port group, a third discharge port group, and a fourth discharge port group, each of which includes plurality of discharge ports for discharging liquid, a first flow path connecting a first liquid tank to the first discharge port group, a second flow path connecting a second liquid tank to the second discharge port group, and a third flow path connecting a third liquid tank to the third discharge port group and the fourth discharge port group, wherein a flow resistance in the first flow path is smaller than a flow resistance in the second flow path and larger than a flow resistance in the third flow path, and wherein a ratio of the flow resistance in the second flow path to the flow resistance in the third flow path is 4 or less.

According to another aspect of the present disclosure, a liquid discharge apparatus includes the above-described liquid discharge head.

According to yet another aspect of the present disclosure, a method for manufacturing a liquid discharge head including a recording element substrate having a first discharge port group, a second discharge port group, a third discharge port group, and a fourth discharge port group, each of which includes a plurality of discharge ports for discharging liquid, first flow path connecting a first liquid tank to the first discharge port group, second flow path connecting a second liquid tank to the second discharge port group, and a third flow path connecting a third liquid tank to the third discharge port group and the fourth discharge port group, the method includes determining size and arrangement of the plurality of discharge ports included in each of the first to the fourth discharge port groups, and determining a length of each of the first to the third flow paths to set a ratio of a largest flow resistance to a smallest flow resistance among flow resistances in the first to the third flow paths to 4 or less.

Further features of the present disclosure will become apparent from the following description of exemplary embodiments with reference to the attached drawings.

DESCRIPTION OF THE EMBODIMENTS

Figure 1:
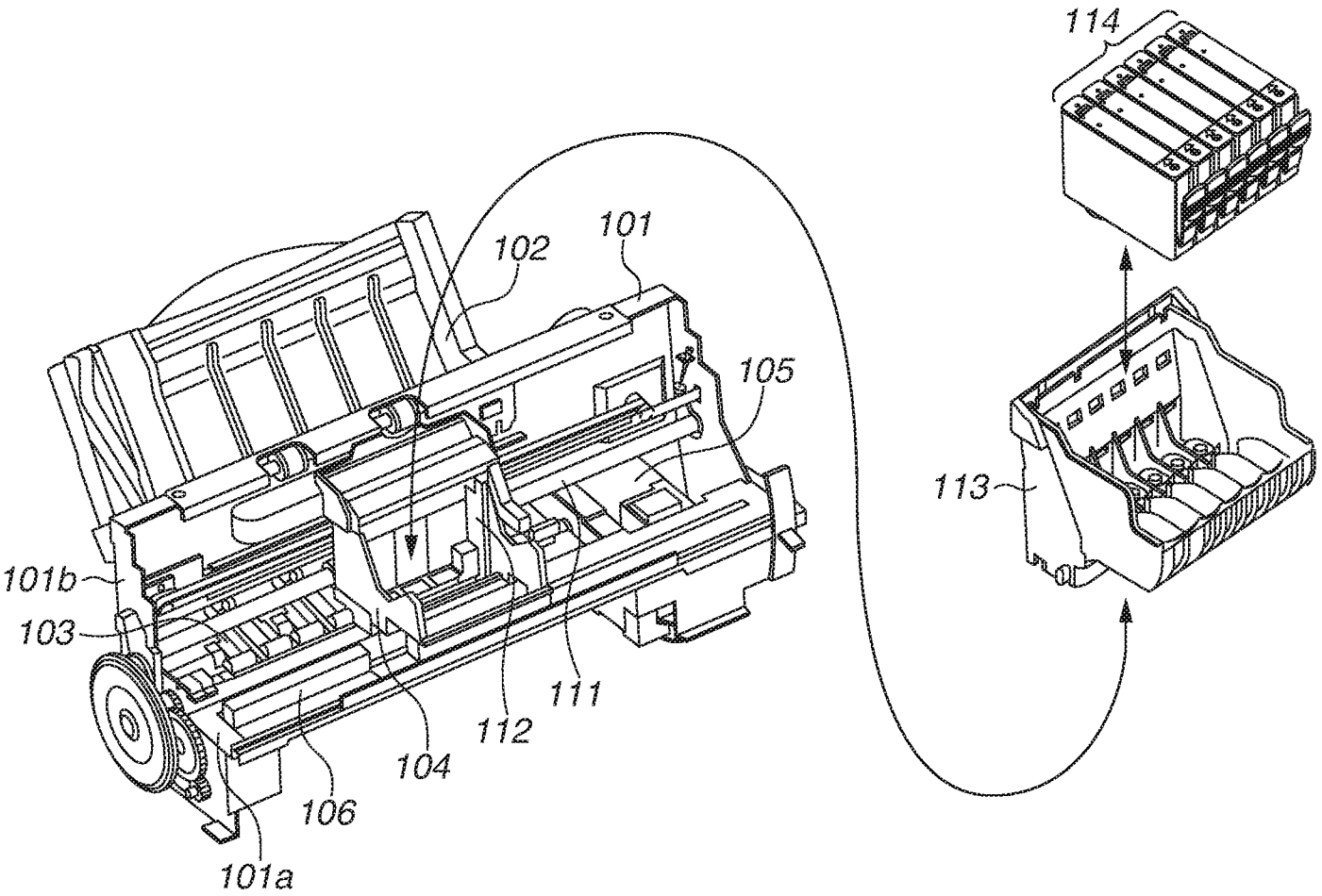
FIG. 1 is a perspective view of a schematic configuration of a liquid discharge apparatus.

Exemplary embodiments of the disclosure will be described below with reference to the attached drawings. In the present specification and drawings, constituent elements having the same function may be provided with the same reference numerals and redundant description thereof will be avoided.

FIG. 1 is a perspective view of a schematic configuration of a liquid discharge apparatus 100. The liquid discharge apparatus 100 is an apparatus that forms an image on a record medium by discharging a liquid, such as ink. The liquid discharge apparatus 100 is, for example, an inkjet recording apparatus. The liquid discharge apparatus 100 has a chassis 101 including a lower case 101*a* and an upper case 101*b*. The lower case 101*a* forms substantially a lower half of the liquid discharge apparatus 100. The upper case 101*b* forms substantially an upper half of the liquid discharge apparatus 100. The chassis 101 is housed in an exterior member (not illustrated). The chassis 101 is configured of one or more sheet metal members having predetermined rigidity, and forms a frame of the liquid discharge apparatus 100. Fitting the upper case 101*b* and the lower case 101*a* forms a hollow body structure having a space therein. The hollow body structure has an opening formed in each of a top surface portion and a front surface portion thereof.

The liquid discharge apparatus 100 has, as a mechanism for performing recording operation, a feeding unit 102 and a conveyance unit 103. The feeding unit 102 feeds a record medium into the main body of the liquid discharge apparatus 100. The conveyance unit 103 guides the record medium sent out from the feeding unit 102, to a desired recording position. The conveyance unit 103 further guides the record medium from the recording position to an eject unit 106. The liquid discharge apparatus 100 further has, as the mechanism for performing the recording operation, a recording unit 104 and a recovery unit 105. The recording unit 104 performs recording by discharging the liquid to the record medium conveyed to the recording position. The recovery unit 105 performs a recovery process for, for example, the recording unit 104.

The recording unit 104 has a carriage 112, a liquid discharge head 113, and a plurality of liquid tanks 114. The carriage 112 is movably supported by a carriage axis 111. The liquid discharge head 113 is detachably attached to the carriage 112. The liquid tanks 114 each retain the liquid to be supplied to the liquid discharge head 113. The liquid retained by the liquid tanks 114 is, for example, ink to be used for recording. The liquid discharge head 113 illustrated in FIG. 1 is of a so-called cartridge type, which is detachably attachable to the carriage 112. The liquid discharge head 113 may be of a type other than the cartridge type. For example, the liquid discharge head 113 may be of a head-tank integrated cartridge type in which the liquid tanks 114 and the liquid discharge head 113 are integrated into one unit to be detachably attachable to the carriage 112. Alternatively, the liquid discharge head 113 may be integral with the carriage 112, and the liquid tanks 114 may be detachably attachable to the liquid discharge head 113. The liquid tanks 114 retain different types of liquids, e.g., of different colors. Each of the liquid tanks 114 retains a different color of inks, for example, black, gray, cyan, magenta, and yellow inks, and is individually detachably attachable to the liquid discharge head 113. Alternatively, instead of having an independent-type configuration illustrated in FIG. 1, the liquid tanks 114 may have such a configuration that a plurality of liquid retention chambers is accommodated in a single housing and each of the liquid retention chambers retains a different liquid.

Figure 2:
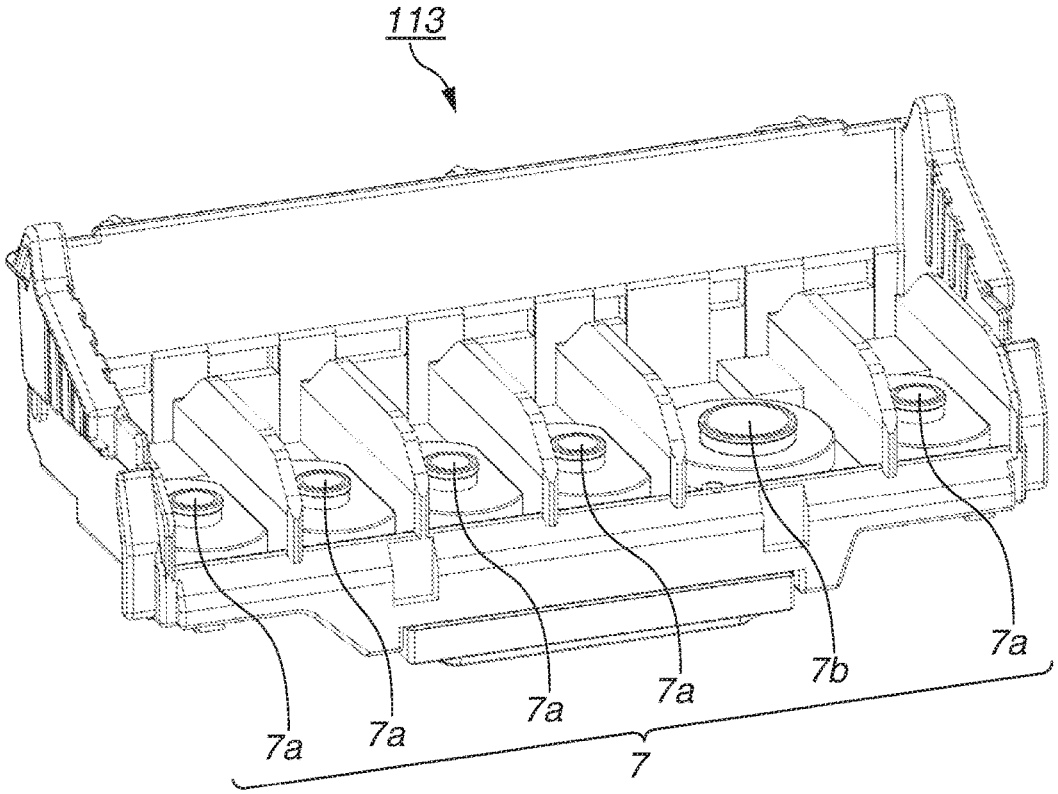
FIG. 2 is a perspective view of a liquid discharge head.
Figure 3:
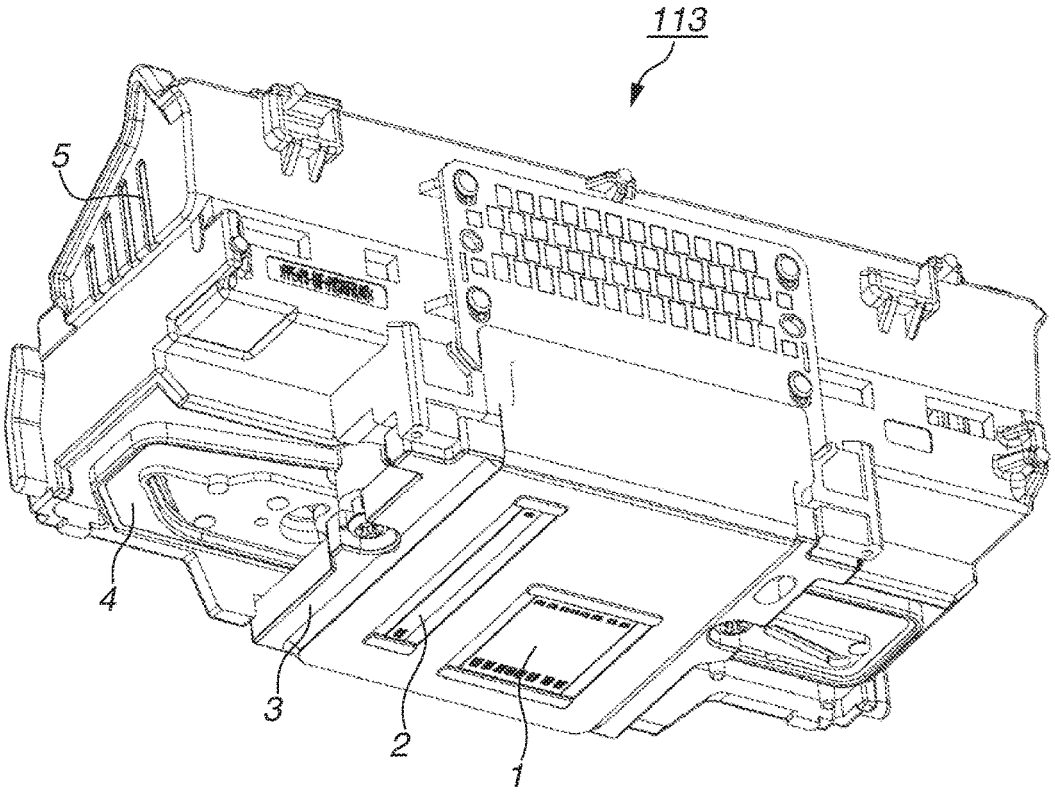
FIG. 3 is a perspective view of the liquid discharge head.

FIGS. 2 and 3 are perspective views of the liquid discharge head 113. As illustrated in FIG. 2, one side of the liquid discharge head 113 is partitioned to a plurality of spaces each for containing a different one of the liquid tanks 114. A filter 7 is provided in each of the spaces. The filter 7 includes filters 7*a* for chromatic color ink and a filter 7*b* for black ink. The filter 7 is pressed against a liquid supply port (not illustrated) of the liquid tanks 114 to catch dust and bubbles in the liquid supplied from the liquid tanks 114. The dust and bubbles are thus prevented from entering the liquid discharge head 113.

As illustrated in FIG. 3, the liquid discharge head 113 has a recording element substrate 1 for chromatic color ink, a recording element substrate 2 for black ink, a support substrate 3, a flow path forming member 4, and a chip tank 5. The recording element substrate 1 for chromatic color ink and the recording element substrate 2 for black ink are substrates, such as silicon substrates, on which energy generating elements and electrical wiring are formed. The energy generating elements generate energy for discharging the liquid. The electrical wiring supplies power to each of the energy generating elements. Further, the recording element substrates 1 and 2 have discharge ports, each formed at a position corresponding to a different one of the energy generating elements, for discharging the liquid. On the back of the side in which the discharge ports are formed, supply ports (not illustrated) are formed. Each of the supply ports communicates with different one of the discharge ports, and serves as an opening for receiving supply of the liquid. The recording element substrates 1 and 2 described above are fixed to adhere to the support substrate 3. Each of the supply ports formed in the recording element substrates 1 and 2 forms a space together with the support substrate 3. The space is for holding the liquid as a liquid chamber. The liquid discharge head 113 has flow paths connecting the supply ports formed in the recording element substrates 1 and 2 to the filter 7.

Figure 4:
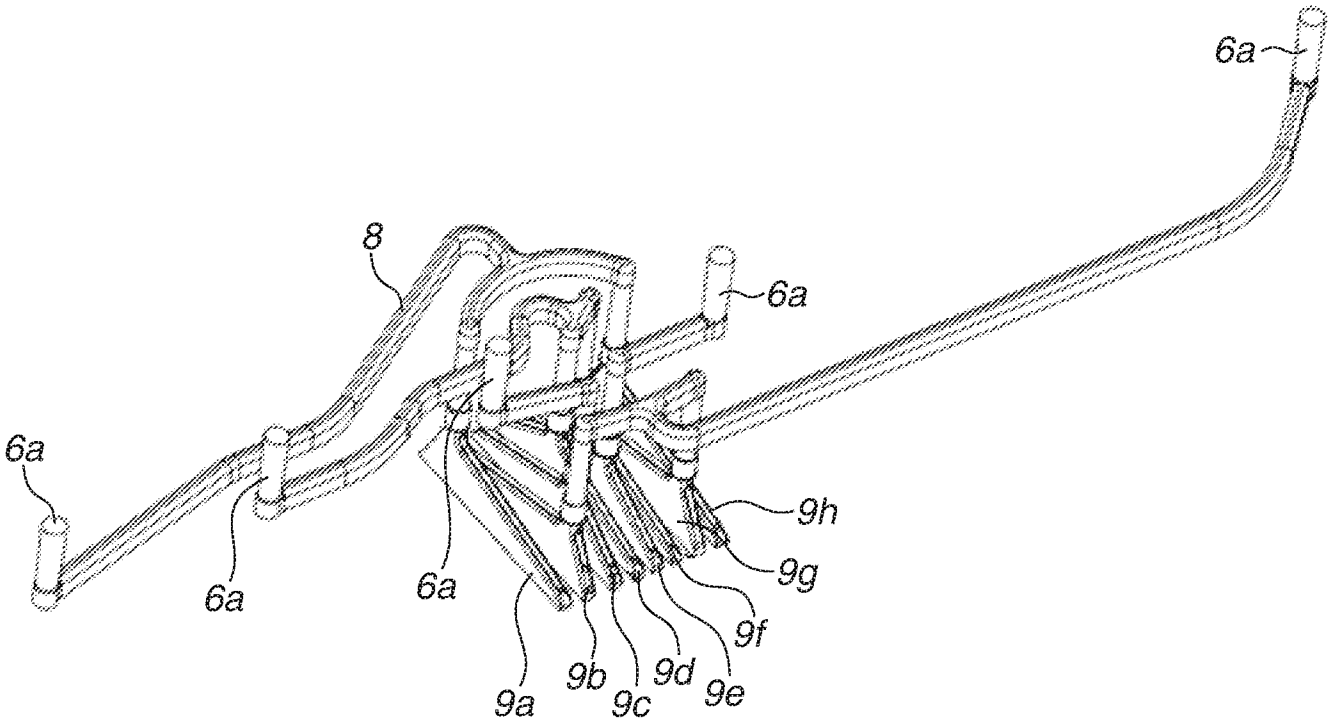
FIG. 4 is a diagram illustrating a suction mechanism of the liquid discharge apparatus.
Figure 5:
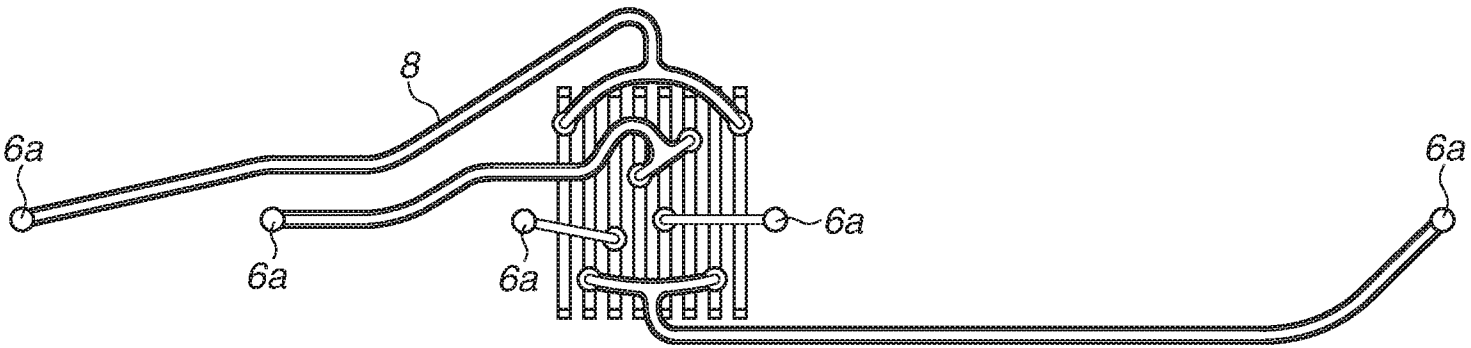
FIG. 5 is a diagram illustrating a flow path configuration according to a first exemplary embodiment of the disclosure.

FIGS. 4 and 5 illustrate an example of a flow path configuration for connecting the supply ports formed in the recording element substrate 1 for chromatic color ink to the filters 7*a* illustrated in FIG. 2. FIG. 5 is a plan view corresponding to FIG. 4. A supply flow path 6*a* illustrated in FIGS. 4 and 5 is connected to a different one of the filters 7*a* illustrated in FIG. 2. The supply flow path 6*a* runs in a thickness direction of the recording element substrate 1. A horizontal flow path 8 connects the supply flow path 6*a* to a different one of liquid chambers 9*a* to 9*h*. The horizontal flow path 8 runs almost in parallel with an in-plane direction of the recording element substrate 1. The horizontal flow path 8 is formed by the flow path forming member 4 illustrated in FIG. 3. The liquid chambers 9*a* and 9*h* are branched from one flow path and are supplied with the same liquid. The liquid chambers 9*b* and 9*g*, as well as the liquid chambers 9*d* and 9*f*, are configured similarly to the liquid chambers 9*a* and 9*h*. Each of the liquid chambers 9*a* to 9*h* corresponds to a discharge port array. The liquid is supplied from each of the liquid chambers 9*a* to 9*h* to the discharge ports. Accordingly, the supply flow path 6*a* and the horizontal flow path 8 form a part of a flow path that connects the liquid tank 114 to the discharge port array.

Figure 6:
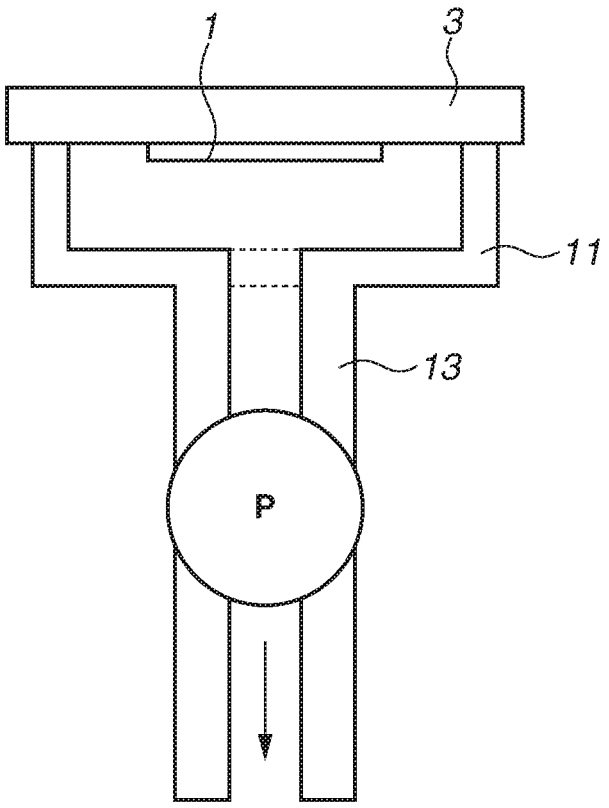
FIG. 6 is a diagram illustrating a flow path configuration according to the first exemplary embodiment of the disclosure.

FIG. 6 illustrates a mechanism for suctioning an air bubble generated at the recording element substrate 1 for chromatic color ink. A cap 11 dedicated for chromatic color ink is provided to cover the recording element substrate 1 for chromatic color ink which is fixed to the support substrate 3. A tube 13 for ink suction is connected to the cap 11 dedicated for chromatic color ink, and a suction pump P is connected to the tube 13. The suction pump P depressurizes the inside of the cap 11 dedicated for chromatic color ink by applying negative pressure. The liquids are thus suctioned simultaneously from the discharge ports provided in the recording element substrate 1.

The desirable negative pressure in suction in this process is a degree sufficient for removing the air bubble by suction and not drawing a bubble from the liquid tank. Such a degree of negative pressure in suction varies depending on the flow resistances in the entire paths from liquid tanks to discharge ports. It is therefore desirable to set differences of flow resistances within a predetermined range. Specifically, a desirable flow-resistance ratio among the flow paths connected to the discharge ports which are subjected to simultaneous suction is 4 or less. In other words, the desirable ratio of the highest flow resistance to the lowest flow resistance is 4 or less. If flow paths having a large flow-resistance difference are simultaneously subjected to a suction recovery process, the amount of the liquid suctioned from a flow path having a small flow resistance is larger than the amount of the liquid suctioned from a flow path having a large flow resistance. This increases the amount of waste ink accompanying the suction recovery process and raises running cost. Further, if the negative pressure of suction is applied to the extent that an air bubble can be sufficiently suctioned from the flow path having the large flow resistance, the negative pressure of suction is too large for the flow path having the small flow resistance. Consequently, the rate of supply flow from the liquid tank increases, and a bubble may be drawn together with the liquid into the flow path. In contrast, if the negative pressure of suction is applied to the extent that an air bubble can be sufficiently suctioned from the flow path having the small flow resistance, the negative pressure of suction is too small for the flow path having the large flow resistance. Consequently, the air bubble may not be sufficiently suctioned from the flow path having the large flow resistance.

Flow resistance in a flow path varies depending on, for example, the sum of the opening areas of the discharge ports to which the flow path is connected, the length of the flow path, and the thickness of the flow path. The sum of the opening areas of the discharge ports varies depending on the size and the number of the discharge ports. When a configuration including the size and arrangement of the discharge ports is determined according to the function of the liquid discharge apparatus, the length of each of the flow paths can be determined so that the flow-resistance ratio is 4 or less, by adjusting the placement of the liquid tank to be connected to each of the flow paths, and the route of each of the flow paths, according to the configuration of the discharge ports.

Figure 7:
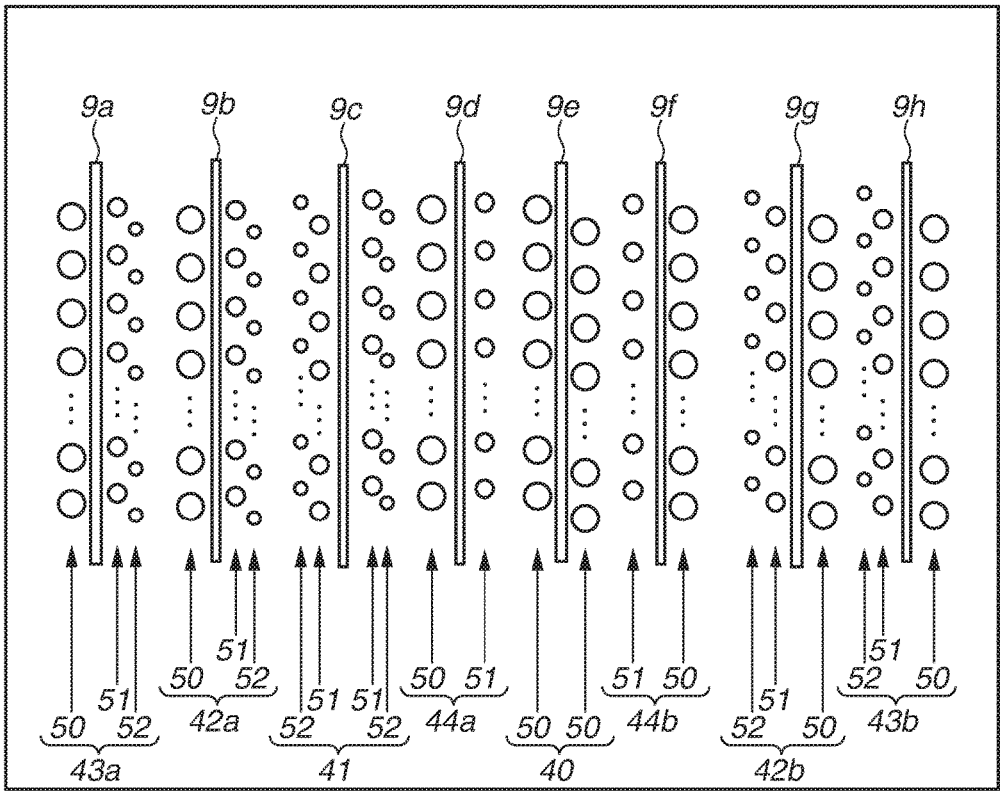
FIG. 7 is a diagram illustrating a configuration of discharge port arrays according to the first exemplary embodiment of the disclosure.

FIG. 7 is a diagram illustrating an example of a configuration of discharge ports of a recording element substrate 1 according to a first exemplary embodiment of the disclosure.

The recording element substrate 1 includes discharge ports classified into three types, that are large discharge ports 50, medium discharge ports 51, and small discharge ports 52, which have difference in liquid discharge amounts. The medium discharge ports 51 are smaller than the large discharge ports 50, and the small discharge ports 52 are smaller than the medium discharge ports 51. The discharge ports of these three types are divided into discharge port groups each including plurality of discharge ports receiving the liquid from a single liquid chamber 9. Specifically, the recording element substrate 1 has a cyan discharge port group 43*a*, a magenta discharge port group 42*a*, and a gray discharge port group 41. The cyan discharge port group 43*a* is supplied with ink of cyan color from a liquid chamber 9*a*. The magenta discharge port group 42*a* is supplied with ink of magenta color from a liquid chamber 9*b*. The gray discharge port group 41 is supplied with ink of gray color from a liquid chamber 9*c*. The recording element substrate 1 further has a black discharge port group 44*a* and a yellow discharge port group 40. The black discharge port group 44*a* is supplied with ink of black color from a liquid chamber 9*d*. The yellow discharge port group 40 is supplied with ink yellow color from a liquid chamber 9*e*. Furthermore, the recording element substrate 1 has a black discharge port group 44*b*, a magenta discharge port group 42*b*, and a cyan discharge port group 43*b*. The black discharge port group 44*b* is supplied with ink of black color from a liquid chamber 9*f*. The magenta discharge port group 42*b* is supplied with ink of magenta color from a liquid chamber 9*g*. The cyan discharge port group 43*b* is supplied with ink of cyan color from a liquid chamber 9*h*.

The cyan discharge port groups 43*a* and 43*b* as well as the magenta discharge port groups 42*a* and 42*b* each include one discharge port array of the large discharge ports 50, one discharge port array of the medium discharge ports 51, and one discharge port array of the small discharge ports 52. The gray discharge port group 41 includes two discharge port arrays of the medium discharge ports 51, and two discharge port arrays of the small discharge ports 52. The black discharge port groups 44*a* and 44*b* each include one discharge port array of the large discharge ports 50 and one discharge port array of the medium discharge ports 51. The yellow discharge port group includes two discharge port arrays of the large discharge ports 50.

The liquid chambers 9*a* and 9*h* are branched from one flow path and configured be supplied with the same liquid, as illustrated in FIG. 4. The liquid chambers 9*b* and 9*g*, as well as the liquid chambers 9*d* and 9*f*, are similarly configured. Therefore, the ink of the same color is supplied from the one liquid tank to each of the cyan discharge port groups 43*a* and 43*b*. This holds true for the magenta discharge port groups 42*a* and 42*b*, as well as the black discharge port groups 44*a* and 44*b*.

As illustrated in FIG. 7, the discharge port groups each include the discharge ports varying in size and number. The sum of the opening areas of the discharge ports varies among the discharge port groups. In the example illustrated in FIG. 7, the sum of the opening areas of the discharge ports is the largest in the cyan discharge port groups 43*a* and 43*b* as well as the magenta discharge port groups 42*a* and 42*b*, and the smallest in the gray discharge port group 41. Therefore, in a case where the flow paths connected to the discharge port groups have the same thickness and length, the flow resistance in each of the flow paths connected to the cyan discharge port groups 43*a* and 43*b* as well as the magenta discharge port groups 42*a* and 42*b* is the smallest. Further, the flow resistance in the flow path connected to the gray discharge port group 41 is the largest. In this example, the ratio of the flow resistance in the flow path connected to the gray discharge port group 41 to the flow resistance in the flow path connected to the cyan discharge port groups 43*a* and 43*b* or the magenta discharge port groups 42*a* and 42*b* is approximately 3.3, which falls in the range of 4 or less. Even when the flow resistances vary due to a manufacturing process, the flow-resistance ratio is approximately 3.8. In a case where this flow-resistance ratio falls in the range of 4 or less, the discharge port groups can be covered with a single cap and simultaneously subjected to a suction recovery process.

In this example, to achieve the flow-resistance ratio of 4 or less, the length of the flow path connected to the gray discharge port group 41 having the largest flow resistance is set shorter than those of the flow paths for supplying the ink of other colors. The resistance occurring in the flow path connected to the gray discharge port group 41 is thus made small. The length of the flow path is adjusted, by adjusting the placement of the liquid tank to be connected to each of the flow paths, and the route of each of the flow paths, so that the flow-resistance ratio is 4 of less. The flow resistance in the flow path described above refers to the flow resistance in the entire route of each of the flow paths, i.e., the flow resistance in the entire route of each of the flow paths that connect the liquid tanks to the discharge port groups.

The yellow discharge port group 40 is referred to as a first discharge port group. The gray discharge port group 41 is referred to as a second discharge port group of discharge ports that are smaller than large discharge ports of the first discharge port group. In this case, the cyan discharge port group 43*a* or the magenta discharge port group 42*a* is referred to as a third discharge port group or a fifth discharge port group of the large discharge ports and discharge ports that are smaller than the large discharge ports. In a case where the cyan discharge port group 43*a* is referred to as the third discharge port group, the cyan discharge port group 43*b* is referred to as a fourth discharge port group. In a case where the cyan discharge port group 43*a* is referred to as the fifth discharge port group, the cyan discharge port group 43*b* is referred to as a sixth discharge port group. Further, the black discharge port group 44*a* is referred to as a seventh discharge port group, and the black discharge port group 44*b* is referred to as an eighth discharge port group.

Figure 8:
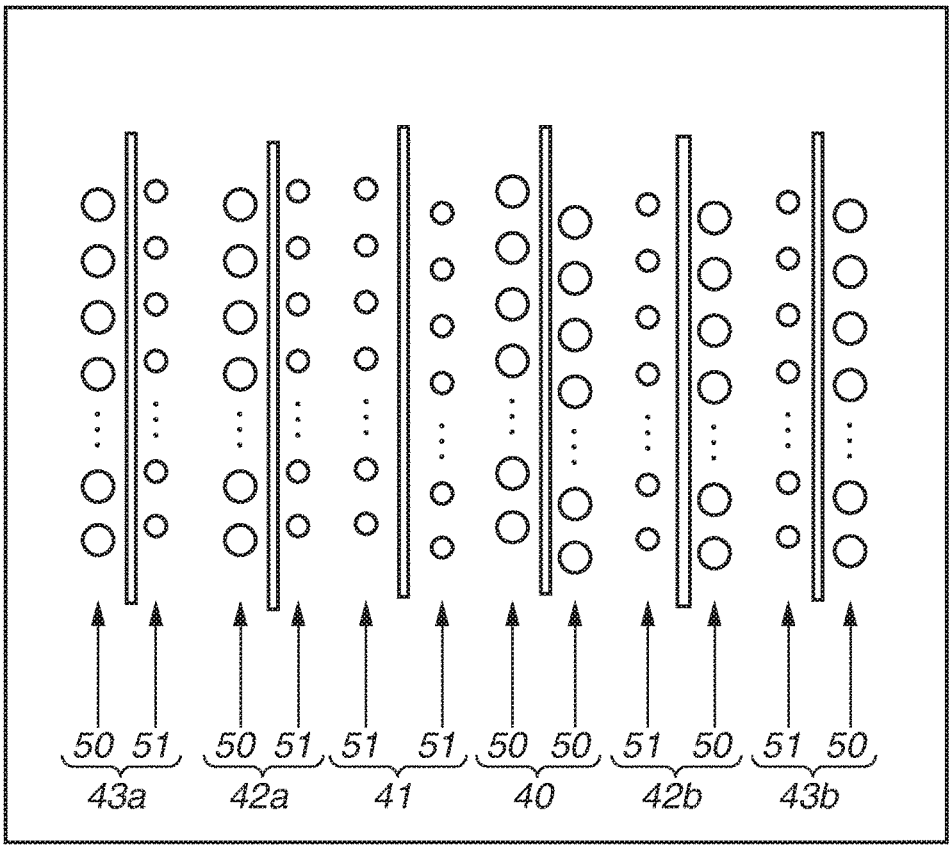
FIG. 8 is a diagram illustrating a configuration of discharge port arrays according to a second exemplary embodiment of the disclosure.

FIG. 8 is a diagram illustrating an example of a configuration of discharge ports of a recording element substrate 1 for chromatic color ink mounted on a liquid discharge head 113 according to a second exemplary embodiment of the disclosure.

To reduce the size of the liquid discharge head 113 according to the first exemplary embodiment, the recording element substrate 1 in the present exemplary embodiment is not provided with the black discharge port group 44. In the present exemplary embodiment, the recording element substrate 1 has six liquid chambers, and six discharge port groups each formed corresponding to the six liquid chambers. In addition, in the present exemplary embodiment, the small discharge ports 52 is not provided in the recording element substrate 1, and the recording element substrate 1 has two types of discharge ports, which are the large discharge ports 50 and the medium discharge ports 51. The cyan discharge port groups 43*a* and 43*b* are symmetrically provided on both sides of the yellow discharge port group 40. The magenta discharge port groups 42*a* and 42*b* are similarly provided. The gray discharge port group 41 is provided between the yellow discharge port group 40 and the magenta discharge port group 42*a*. This can suppress interference of airflow between the yellow discharge port group 40 and the magenta discharge port group 42*a*.

The yellow discharge port group 40 includes two discharge port arrays including only the large discharge ports 50. The gray discharge port group 41 includes discharge ports smaller than the large discharge ports 50. In the example illustrated in FIG. 8, the gray discharge port group 41 includes two discharge port arrays including only the medium discharge ports 51. The cyan discharge port groups 43*a* and 43*b* as well as the magenta discharge port groups 42*a* and 42*b* each include the large discharge ports 50 and discharge ports smaller than the large discharge ports 50. In the example illustrated in FIG. 8, the cyan discharge port groups 43*a* and 43*b* as well as the magenta discharge port groups 42*a* and 42*b* each include one discharge port array of the large discharge ports 50, and one discharge port array of the medium discharge ports 51.

In the configuration illustrated in FIG. 8, the sum of the opening areas of the discharge ports is the largest in the cyan discharge port groups 43*a* and 43*b* as well as the magenta discharge port groups 42*a* and 42*b*, and the smallest in the gray discharge port group 41, as in the first exemplary embodiment. Therefore, in a case where flow paths connected to the discharge port groups have the same thickness and length, the flow resistance in each of the flow paths connected to the cyan discharge port groups 43*a* and 43*b* as well as the magenta discharge port groups 42*a* and 42*b* is the smallest. Further, the flow resistance in the flow path connected to the gray discharge port group 41 is the largest. The ratio of the flow resistance in the flow path connected to the gray discharge port group 41 to the flow resistance in the flow path connected to the cyan discharge port groups 43*a* and 43*b* or the magenta discharge port groups 42*a* and 42*b* is thus set to 4 or less. Accordingly, a plurality of discharge port groups can be covered with a single cap and simultaneously subjected to a suction recovery process.

Modification Examples

FIGS. 9 to 13 illustrate modification examples of the second exemplary embodiment of the disclosure.

Figure 9:
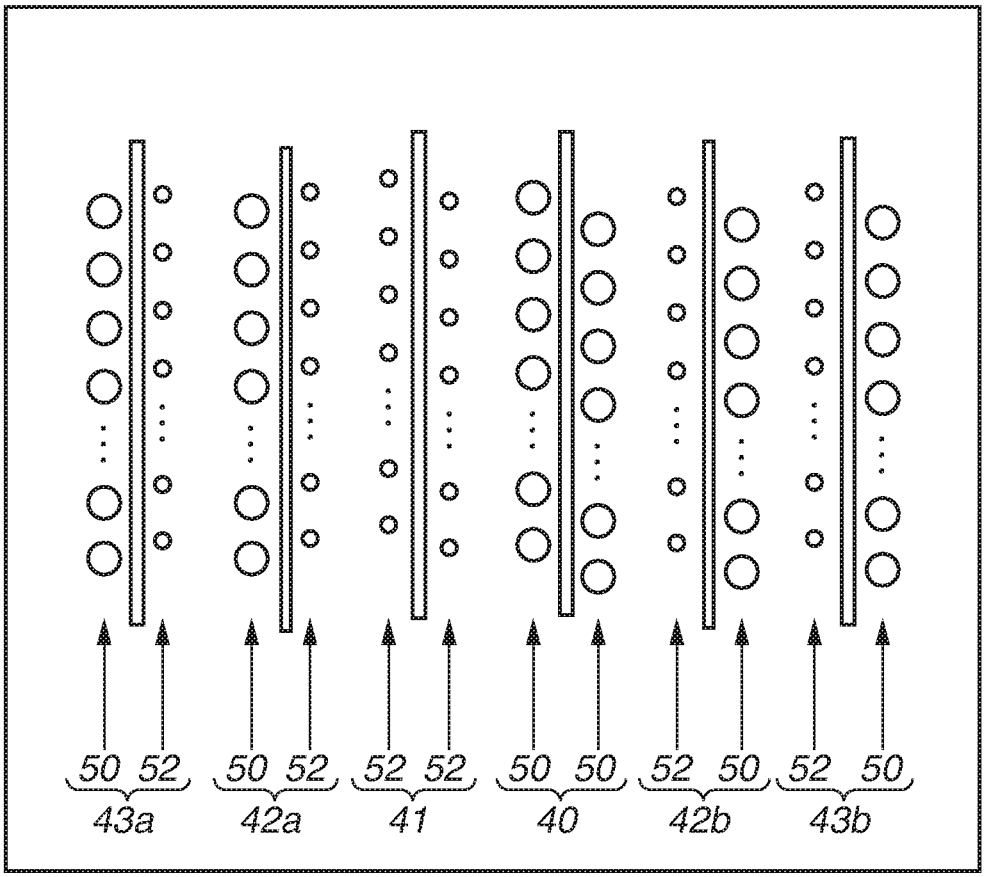
FIG. 9 is a diagram illustrating a configuration of discharge ports according to a first modification example of the second exemplary embodiment of the disclosure.

FIG. 9 illustrates a first modification example of the second exemplary embodiment. In the second exemplary embodiment illustrated in FIG. 8, the recording element substrate 1 has the two types of discharge ports that are the large discharge ports 50 and the medium discharge ports 51.

In contrast, in the first modification example, the recording element substrate 1 has the small discharge ports 52 in place of the medium discharge ports 51. Specifically, in the first modification example, the gray discharge port group 41 includes discharge ports smaller than the large discharge ports 50. To be more specific, the gray discharge port group 41 includes two discharge port arrays of the small discharge ports 52. The cyan discharge port groups 43*a* and 43*b* as well as the magenta discharge port groups 42*a* and 42*b* each include one discharge port array of the large discharge ports 50 and one discharge port array of the small discharge ports 52. The yellow discharge port group 40 includes two discharge port arrays of the large discharge ports 50, as in the second exemplary embodiment.

Figure 10:
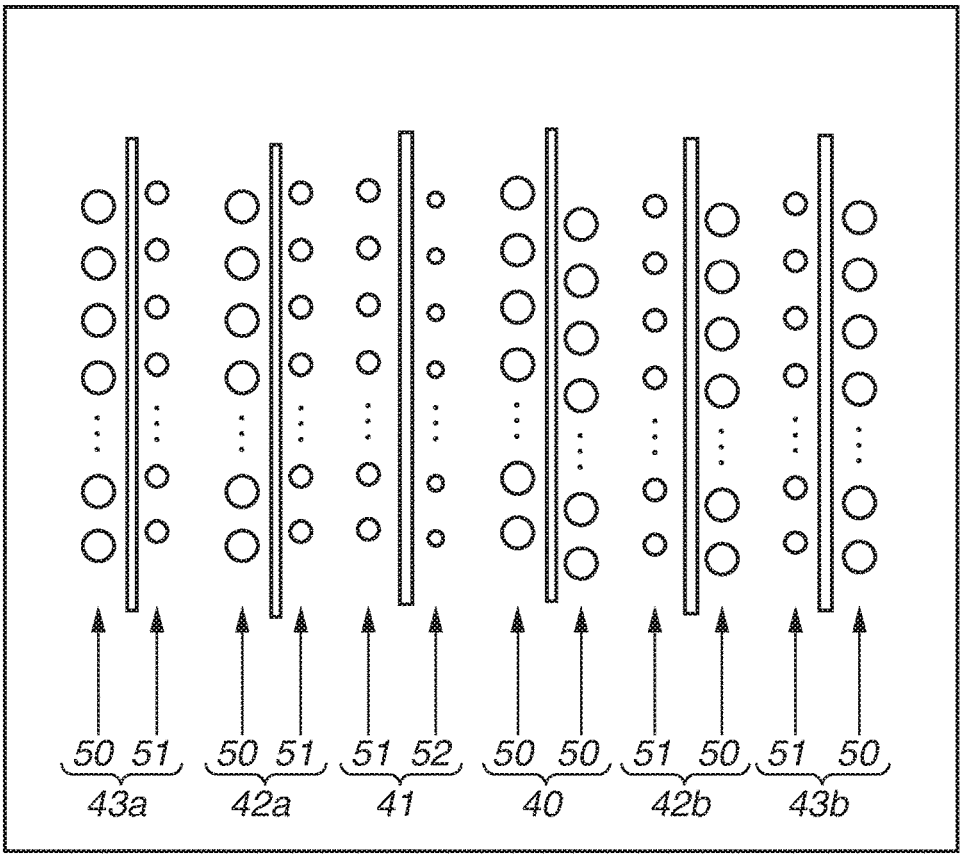
FIG. 10 is a diagram illustrating a configuration of discharge ports according to a second modification example of the second exemplary embodiment of the disclosure.

FIG. 10 illustrates a second modification example of the second exemplary embodiment. In the second modification example, the small discharge ports 52 are provided in place of some of the medium discharge ports 51 included in the configuration illustrated in FIG. 8. Specifically, in the second modification example, the yellow discharge port group 40 includes two discharge port arrays of the large discharge ports 50, as in the second exemplary embodiment. The gray discharge port group 41 includes one discharge port array of the medium discharge ports 51 and one discharge port array of the small discharge ports 52. The cyan discharge port groups 43*a* and 43*b* as well as the magenta discharge port groups 42*a* and 42*b* each include one discharge port array of the large discharge ports 50 and one discharge port array of the medium discharge ports 51.

Figure 11:
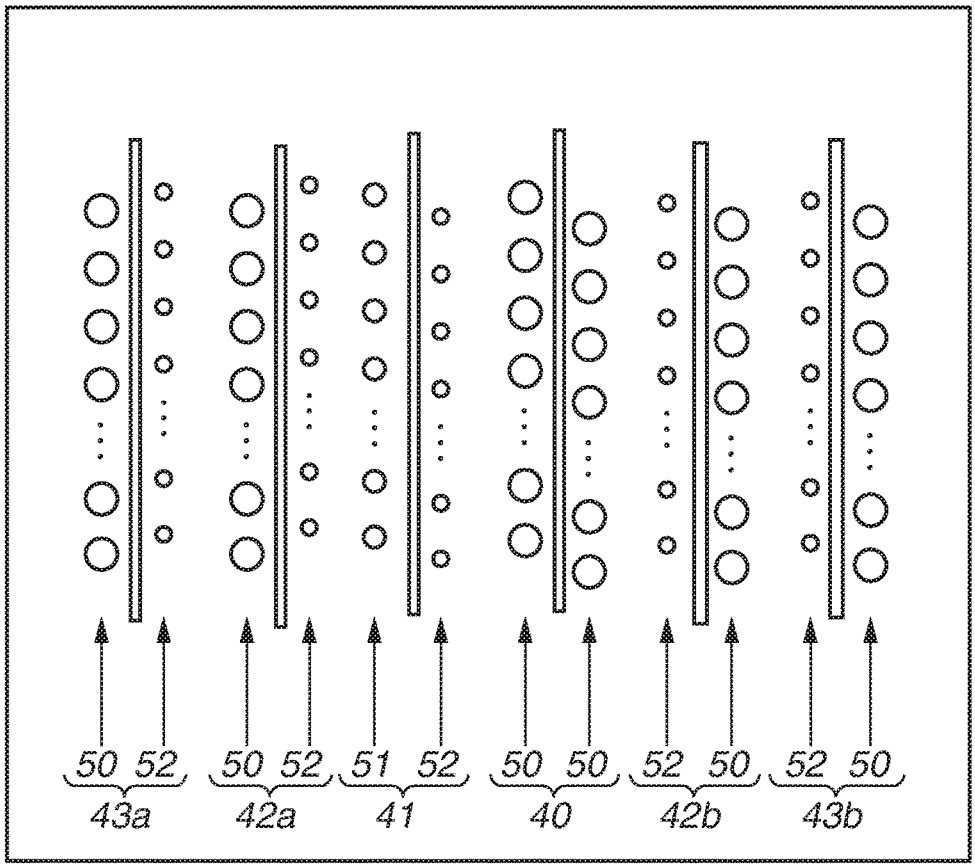
FIG. 11 is a diagram illustrating a configuration of discharge ports according to a third modification example of the second exemplary embodiment of the disclosure.

FIG. 11 illustrates a third modification example of the second exemplary embodiment. In the third modification example, the yellow discharge port group 40 includes two discharge port arrays of the large discharge ports 50, as in the second exemplary embodiment. The gray discharge port group 41 includes one discharge port array of the medium discharge ports 51 and one discharge port array of the small discharge ports 52. The cyan discharge port groups 43*a* and 43*b* as well as the magenta discharge port groups 42*a* and 42*b* each include one discharge port array of the large discharge ports 50 and one discharge port array of the small discharge ports 52.

Figure 12:
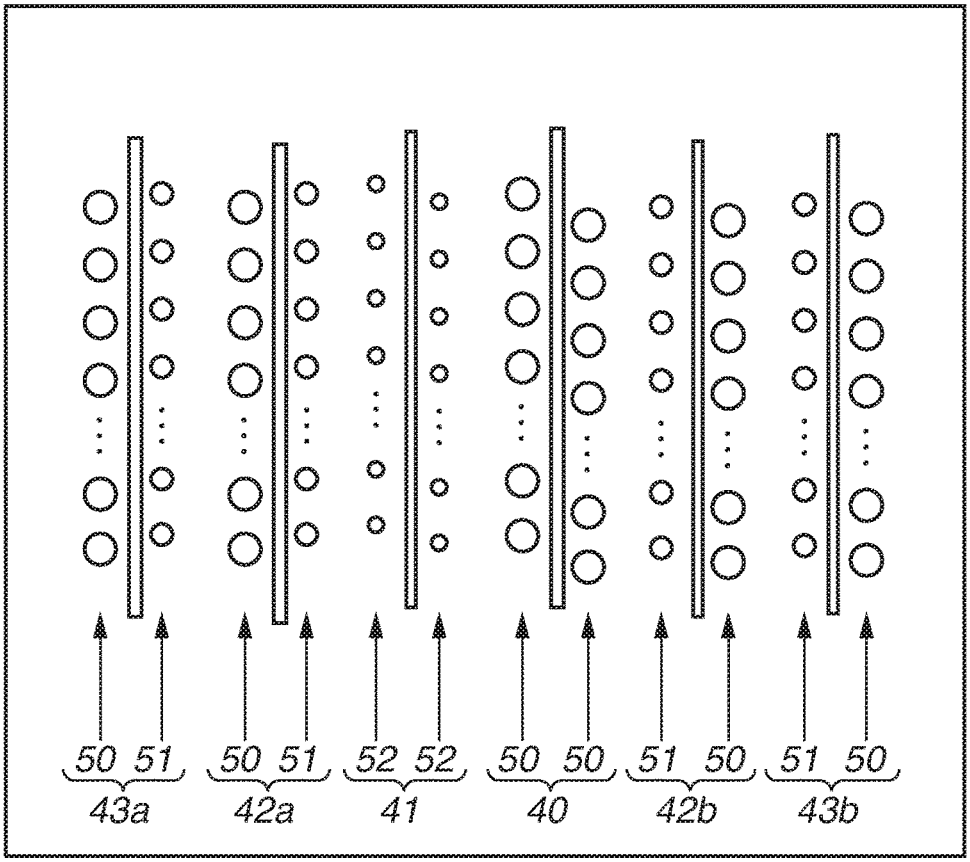
FIG. 12 is a diagram illustrating a configuration of discharge ports according to a fourth modification example of the second exemplary embodiment of the disclosure.

FIG. 12 illustrates a fourth modification example of the second exemplary embodiment. In the fourth modification example, the yellow discharge port group 40 includes two discharge port arrays of the large discharge ports 50, as in the second exemplary embodiment. The gray discharge port group 41 includes two discharge port arrays of the small discharge ports 52. The cyan discharge port groups 43*a* and 43*b* as well as the magenta discharge port groups 42*a* and 42*b* each include one discharge port array of the large discharge ports 50 and one discharge port array of the medium discharge ports 51.

Figure 13:
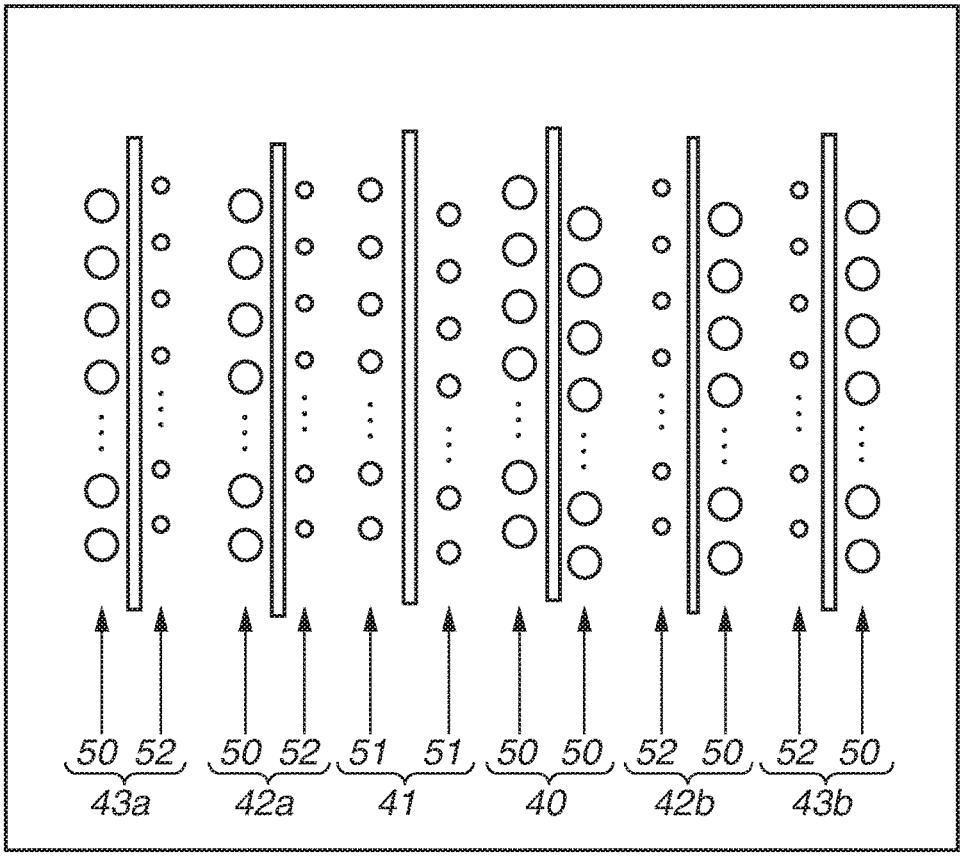
FIG. 13 is a diagram illustrating a configuration of discharge ports according to a fifth modification example of the second exemplary embodiment of the disclosure.

FIG. 13 illustrates a fifth modification example of the second exemplary embodiment. In the fifth modification example, the yellow discharge port group 40 includes two discharge port arrays of the large discharge ports 50, as in the second exemplary embodiment. The gray discharge port group 41 includes two discharge port arrays of the medium discharge ports 51. The cyan discharge port groups 43*a* and 43*b* as well as the magenta discharge port groups 42*a* and 42*b* each include one discharge port array of the large discharge ports 50 and one discharge port array of the small discharge ports 52.

In the modification examples of the second exemplary embodiment of the disclosure illustrated in FIGS. 9 to 13, likewise, the sum of the opening areas of the discharge ports is the largest in the cyan discharge port groups 43*a* and 43*b* as well as the magenta discharge port groups 42*a* and 42*b*, and the smallest in the gray discharge port group 41. Therefore, in a case where flow paths connected to the discharge port groups have the same thickness and length, the flow resistance in each of the flow paths connected to the cyan discharge port groups 43*a* and 43*b* as well as the magenta discharge port groups 42*a* and 42*b* is the smallest. Further, the flow resistance in the flow path connected to the gray discharge port group 41 is the largest. The ratio of the flow resistance in the flow path connected to the gray discharge port group 41 to the flow resistance in the flow path connected to the cyan discharge port groups 43*a* and 43*b* or the magenta discharge port groups 42*a* and 42*b* is thus set to 4 or less. Accordingly, a plurality of discharge port groups can be covered with a single cap and simultaneously subjected to the suction recovery process.

Figure 14:
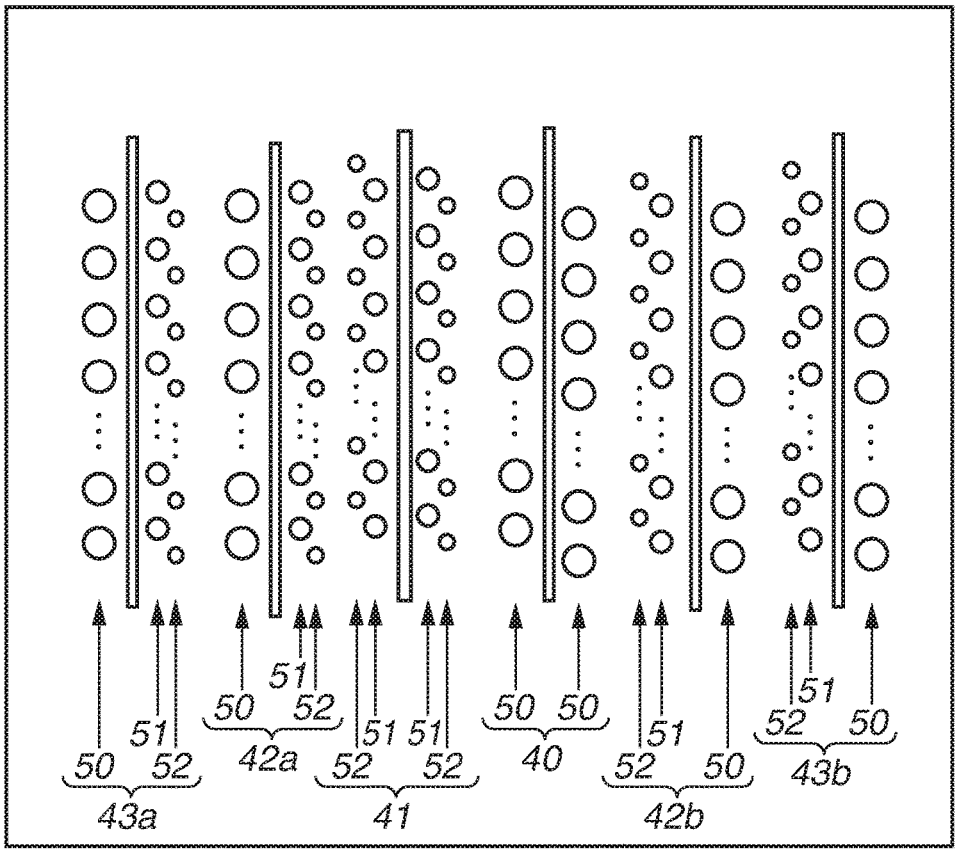
FIG. 14 is a diagram illustrating a configuration of discharge ports according to a third exemplary embodiment of the disclosure.

FIG. 14 illustrates a third exemplary embodiment of the disclosure. The third exemplary embodiment provides a gradation property improved from that in the liquid discharge head 113 according to the second exemplary embodiment. To this end, a gray discharge port group 41 has four discharge port arrays of two types of discharge ports, and cyan discharge port groups 43*a* and 43*b* as well as magenta discharge port groups 42*a* and 42*b* each include three discharge port arrays of three types of discharge ports. Specifically, the gray discharge port group 41 includes two discharge port arrays of the medium discharge ports 51 and two discharge port arrays of the small discharge ports 52. The cyan discharge port groups 43*a* and 43*b* as well as the magenta discharge port groups 42*a* and 42*b* each include one discharge port array of the large discharge ports 50, one discharge port array of the medium discharge ports 51, and one discharge port array of the small discharge ports 52. A yellow discharge port group 40 includes two discharge port arrays of the large discharge ports as in the first and the second exemplary embodiments.

In the configuration illustrated in FIG. 14, likewise, the sum of the opening areas of the discharge ports is the largest in the cyan discharge port groups 43*a* and 43*b* as well as the magenta discharge port groups 42*a* and 42*b*, and the smallest in the gray discharge port group 41. Therefore, in a case where flow paths connected to the discharge port groups have the same thickness and length, the flow resistance in each of the flow paths connected to the cyan discharge port groups 43*a* and 43*b* as well as the magenta discharge port groups 42*a* and 42*b* is the smallest. Further, the flow resistance in the flow path connected to the gray discharge port group 41 is the largest. The ratio of the flow resistance in the flow path connected to the gray discharge port group 41 to the flow resistance in the flow path connected to the cyan discharge port groups 43*a* and 43*b* or the magenta discharge port groups 42*a* and 42*b* is thus set to 4 or less. Accordingly, a plurality of discharge port groups can be covered with a single cap and simultaneously subjected to a suction recovery process.

The present disclosure is described above with reference to the exemplary embodiments, but is not limited to the exemplary embodiments. Various modifications that a person skilled in the art can understand within the scope of technical ideas of the present disclosure can be made to configurations and details of the present disclosure.

In the exemplary embodiments described above, the liquid tanks, the flow paths connecting the discharge ports to the liquid tanks, the arrangement and the number of the discharge port groups are described using examples, but the disclosure is not limited to these examples. For example, the placement of the liquid tank retaining the ink of cyan color can be interchanged with the placement of the liquid tank retaining the ink of magenta color.

In the exemplary embodiments described above, the configuration of the liquid discharge head and the liquid discharge apparatus is mainly described. However, it is possible to provide a method for designing a liquid discharge head and a method for manufacturing a liquid discharge apparatus for implementing the above-described configuration.

According to the disclosure, a plurality of liquids can be simultaneously subjected to suction recovery, by reducing a flow-resistance difference between flow paths.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-149980, filed Jul. 29, 2016, which is hereby incorporated by reference herein in its entirety.

What is claimed is:

1. A liquid discharge head comprising:

a recording element substrate having a first discharge port group, a second discharge port group, a third discharge port group, and a fourth discharge port group, each of which includes a plurality of discharge ports for discharging liquid, wherein a sum of opening areas of the plurality of discharge ports included in the first discharge port group is larger than a sum of opening areas of the plurality of discharge ports included in the second discharge port group, and is smaller than a sum of opening areas of the plurality of discharge ports included in the third discharge port group and a sum of opening areas of the plurality of discharge ports included in the fourth discharge port groups;

a first flow path connecting a first liquid tank to the first discharge port group;

a second flow path connecting a second liquid tank to the second discharge port group; and a third flow path connecting a third liquid tank to the third discharge port group and the fourth discharge port group, wherein a flow resistance in the first flow path is smaller than a flow resistance in the second flow path and larger than a flow resistance in the third flow path, and wherein a ratio of the flow resistance in the second flow path to the flow resistance in the third flow path is 4 or less.

2. The liquid discharge head according to claim 1, wherein the first discharge port group includes large discharge ports, wherein the second discharge port group includes discharge ports smaller than the large discharge ports, and wherein the third and the fourth discharge port groups include the large discharge ports and the discharge ports smaller than the large discharge ports.

3. The liquid discharge head according to claim 2, wherein the discharge ports smaller than the large discharge ports include medium discharge ports smaller than the large discharge ports and small discharge ports smaller than the medium discharge ports.

4. A liquid discharge head comprising:

a recording element substrate having a first discharge port group, a second discharge port group, a third discharge port group, and a fourth discharge port group, each of which includes a plurality of discharge ports for discharging liquid;

a first flow path connecting a first liquid tank to the first discharge port group;

a second flow path connecting a second liquid tank to the second discharge port group; and a third flow path connecting a third liquid tank to the third discharge port group and the fourth discharge port group, wherein a flow resistance in the first flow path is smaller than a flow resistance in the second flow path and larger than a flow resistance in the third flow path, wherein a ratio of the flow resistance in the second flow path to the flow resistance in the third flow path is 4 or less, wherein the recording element substrate further has a fifth discharge port group and a sixth discharge port group, wherein the liquid discharge head further includes a fourth flow path connecting a fourth liquid tank to the fifth discharge port group and the sixth discharge port group, wherein a flow resistance in the fourth flow path is smaller than the flow resistance in the first flow path, and wherein a ratio of the flow resistance in the second flow path to the flow resistance in the fourth flow path is 4 or less.

5. The liquid discharge head according to claim 4, wherein the recording element substrate further has a seventh discharge port group and an eighth discharge port group, wherein the liquid discharge head further includes a fifth flow path connecting a fifth liquid tank to the seventh discharge port group and the eighth discharge port group, and wherein a flow resistance in the fifth flow path is smaller than the flow resistance in the third flow path.

6. A liquid discharge apparatus comprising:

a liquid discharge head including a recording element substrate having a first discharge port group, a second discharge port group, a third discharge port group, and a fourth discharge port group, in each of which a plurality of discharge ports for discharging liquid is arranged, a first flow path connecting a first liquid tank and the first discharge port group, a second flow path connecting a second liquid tank and the second discharge port group, and a third flow path connecting a third liquid tank to the third discharge port group and the fourth discharge port group, wherein a sum of opening areas of the plurality of discharge ports included in the first discharge port group is larger than a sum of opening areas of the plurality of discharge ports included in the second discharge port group, and is smaller than a sum of opening areas of the plurality of discharge ports included in the third discharge port group and a sum of opening areas of the plurality of discharge ports included in the fourth discharge port groups, wherein a flow resistance in the first flow path is smaller than a flow resistance in the second flow path and larger than a flow resistance in the third flow path, and wherein a ratio of the flow resistance in the second flow path to the flow resistance in the third flow path is 4 or less; and a carriage configured to hold the liquid discharge head.

* * * * *